US010323835B1

(12) United States Patent
Anderson

(10) Patent No.: US 10,323,835 B1
(45) Date of Patent: Jun. 18, 2019

(54) COMBINATION LED LIGHTING SYSTEM AND ANGLE POWER STRIP

(71) Applicant: Kenneth E. Anderson, Kearney, NE (US)

(72) Inventor: Kenneth E. Anderson, Kearney, NE (US)

( * ) Notice: Subject to any disclaimer, the term of this patent is extended or adjusted under 35 U.S.C. 154(b) by 199 days.

(21) Appl. No.: 15/286,788

(22) Filed: Oct. 6, 2016

(51) Int. Cl.

| | |
|---|---|
| ***H01R 13/00*** | (2006.01) |
| ***F21V 23/06*** | (2006.01) |
| ***F21V 3/02*** | (2006.01) |
| ***F21V 23/00*** | (2015.01) |
| ***F21S 4/28*** | (2016.01) |
| ***H01R 25/00*** | (2006.01) |
| ***H01R 13/717*** | (2006.01) |
| *F21Y 115/10* | (2016.01) |

(52) U.S. Cl.
CPC ..... *F21V 23/06* (2013.01); *F21S 4/28* (2016.01); *F21V 3/02* (2013.01); *F21V 23/003* (2013.01); *H01R 13/7175* (2013.01); *H01R 25/003* (2013.01); *F21Y 2115/10* (2016.08)

(58) Field of Classification Search
CPC ..... H01R 13/717–13/7177; F21L 4/00; F21L 4/04; F21L 4/027
See application file for complete search history.

(56) References Cited

U.S. PATENT DOCUMENTS

| | | | | |
|---|---|---|---|---|
| 7,156,694 | B1 * | 1/2007 | Anderson | F21V 33/0012 439/110 |
| 7,651,365 | B2 * | 1/2010 | Chien | H01R 13/6691 439/490 |
| 2004/0150984 | A1 * | 8/2004 | Robertson | F21V 33/006 362/95 |
| 2014/0293595 | A1 * | 10/2014 | May | F21V 3/0625 362/218 |
| 2015/0176826 | A1 * | 6/2015 | Chien | F21S 8/035 362/253 |

* cited by examiner

*Primary Examiner* — Gerald J Sufleta, II
(74) *Attorney, Agent, or Firm* — Dennis L. Thomte; Thomte Patent Law Office LLC

(57) ABSTRACT

A combination LED lighting system and angle power strip including an elongated and horizontally extending housing which may be placed on a vertical wall below a cabinet or the like. The housing has an inclined front wall which has a plurality of electrical outlets mounted thereon at an acute angle with respect to the wall. The housing also has a lens selectively removably secured thereto which is positioned above the electrical outlets. A LED lighting system is mounted in the housing for directing light downwardly and outwardly through the lens. The ends of the housing have caps removably secured thereto. The housing also has an outer wall member which may be selectively detached from the housing for repair or replacement of the components within the housing.

6 Claims, 8 Drawing Sheets

COMBINATION LED LIGHTING SYSTEM AND ANGLE POWER STRIP

BACKGROUND OF THE INVENTION

Field of the Invention

This invention relates to a LED Lighting System and an Angle Power Strip which are mounted in a single housing which may be positioned beneath a kitchen cabinet located above a kitchen countertop. The invention may also be positioned below a cabinet located above a desk or the like. The invention may also be positioned on a vertically disposed wall above a countertop or desk.

Description of the Related Art

Many lighting devices have been previously provided to be positioned beneath a kitchen cabinet so as to illuminate a countertop. Additionally, many electrical outlet devices have been previously provided for positioning beneath kitchen cabinets to provide electrical power to devices being used on the countertop located below the cabinet. See for example FIGS. 1 and 2 of Applicant's U.S. Pat. No. 7,156,694 which illustrate such prior art electrical outlets. Applicant's U.S. Pat. No. 7,156,694 solved many of the problems associated with the electrical outlets of the prior art. However, to the best of Applicant's knowledge, no one has previously combined an LED lighting system with an angle power strip in a single housing which not only provides convenient access to the electrical outlets of the angle power strip but which also illuminates the countertop or desk located therebelow.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The Combination LED Lighting System and Angle Power Strip of this invention comprises an elongated, horizontally disposed housing including a horizontally disposed upper wall member having an inner end, an outer end, a first end, and a second end. A lens mounting wall member, having upper and lower ends, extends downwardly and outwardly from the outer end of the upper wall member. An intermediate wall member, having upper and lower ends, extends downwardly from the upper wall member inwardly of the outer end of the upper wall member. An angular wall member, having upper and lower ends, extends downwardly and inwardly from the lower end of the intermediate wall member. An elongated arcuate connector shoulder is mounted on the lower end of the angular wall member. A vertically disposed inner wall member, having upper and lower ends, extends downwardly from the inner end of the upper wall member. A horizontally disposed bottom wall member, having inner and outer ends, extends inwardly from the lower end of the inner wall member. The outer end of the bottom wall member has an enlarged ball-like member secured thereto. The housing includes an angularly disposed outer wall member, having upper and lower ends. The upper end of the outer wall member has an inwardly protruding shoulder which has an arcuate recess formed therein. The upper end of the outer wall member is selectively removably secured to its elongated arcuate connector shoulder at the lower end of the angular wall member. The lower end of the outer wall member has an elongated arcuate lip which receives the ball-like member at the inner end of the bottom wall member to selectively removably secure the lower end of the outer wall member. An elongated lens, having a first end, a second end, an upper end edge, and a lower end edge has its upper end edge removably secured to the lens mounting wall member. The lower end edge of the lens is removably secured to the intermediate wall member.

An LED light assembly is positioned between the lens mounting wall member and the intermediate wall member which is configured to direct light downwardly and outwardly through the lens. A plurality of horizontally spaced-apart electrical outlets are positioned on the angularly disposed outer wall member so that the outlets are disposed at an acute angle with respect to the inner wall member and the upper wall member.

In the preferred embodiment, the light lens is translucent. In the preferred embodiment, the light lens has a curved cross-section. In the preferred embodiment, the outer wall member is selectively removably secured to the housing. In the preferred embodiment, the LED light system includes an LED dimmer and the LED system includes an elongated and horizontally disposed LED light bar.

It is therefore a principal object of the invention to provide a combination LED lighting system and an angle power strip in a single housing.

A further object of the invention is to provide a device of the type described which is easy to install and which is easily serviced if needed.

A further object of the invention is to provide a device of the type described which is economical of manufacture and durable in use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
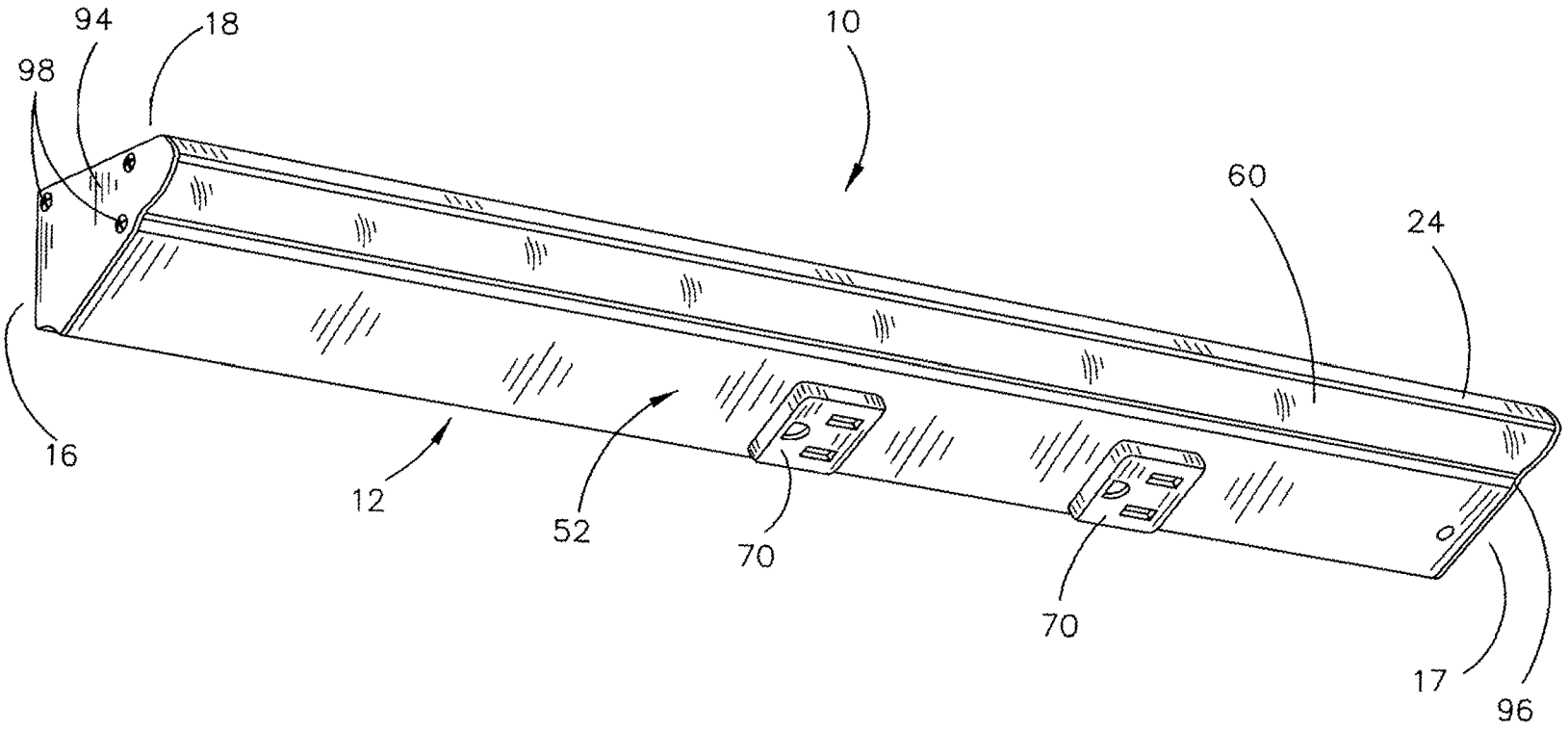
FIG. 1 is a perspective view of the combination LED lighting system and angle power strip of this invention.
Figure 2:
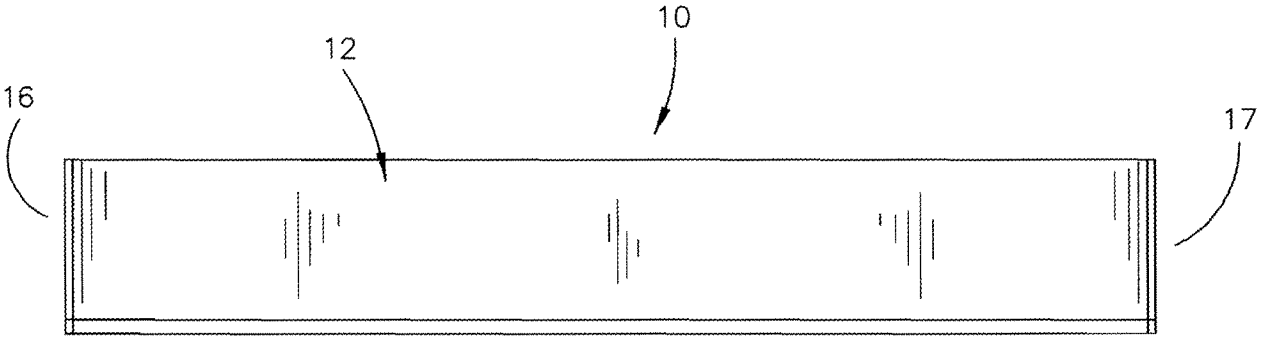
FIG. 2 is a top view of the combination LED lighting system and angle power strip of this invention.
Figure 3:
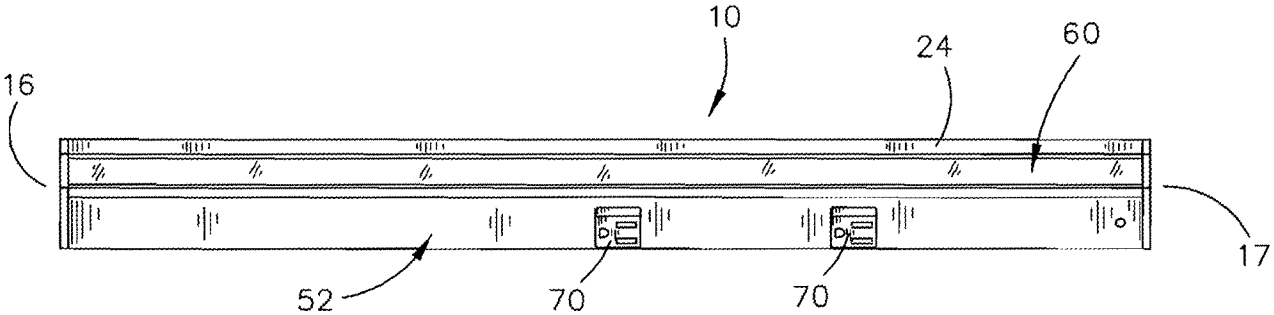
FIG. 3 is a front view of the combination LED lighting system and angle power strip of this invention.
Figure 4:
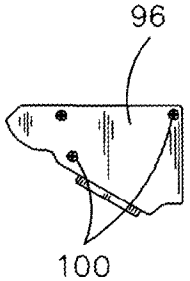
FIG. 4 is an end view of the combination LED lighting system and angle power strip of this invention.
Figure 5:
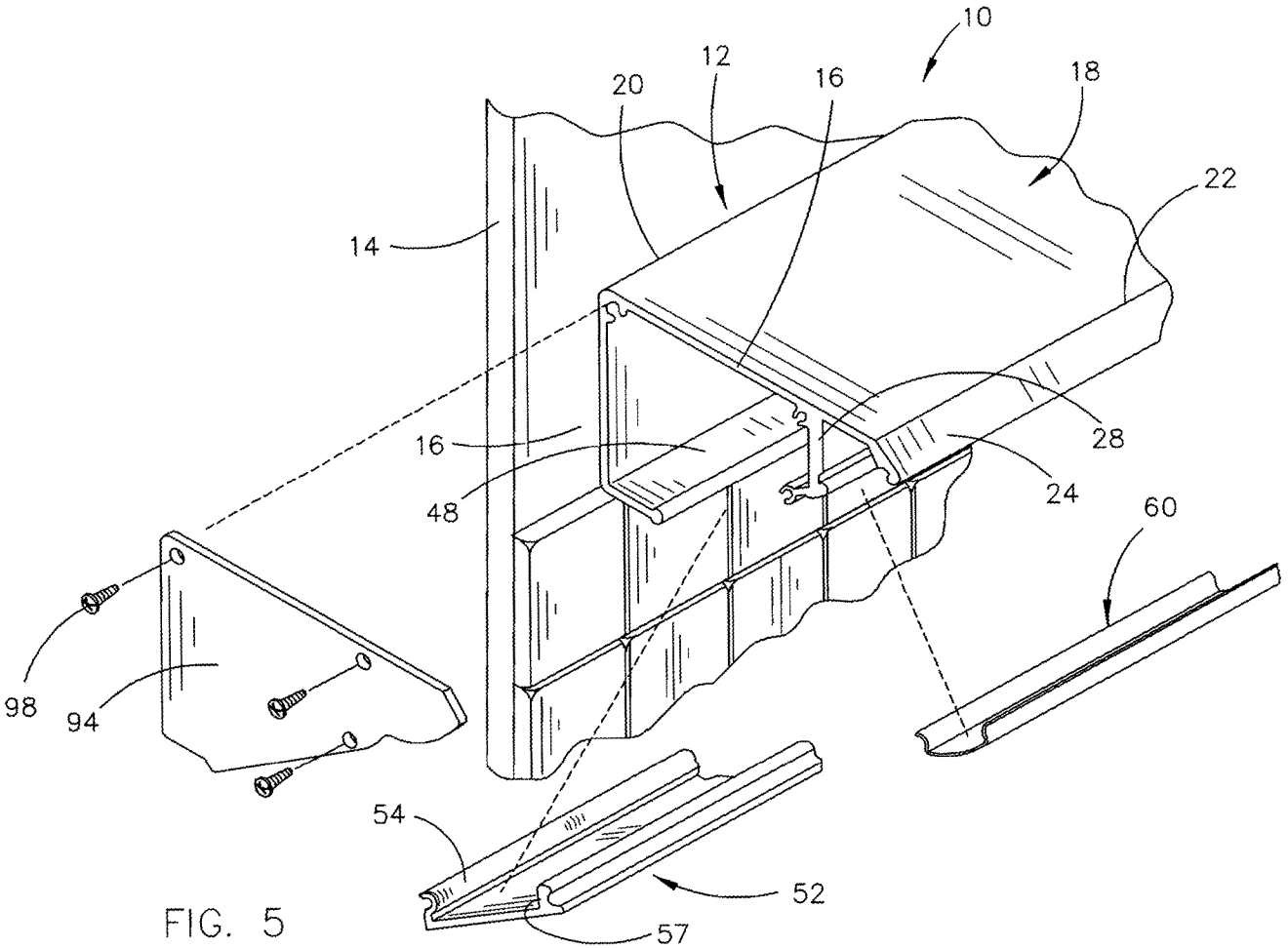
FIG. 5 is a partial exploded perspective view of one end of the combination LED lighting system and angle power strip of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the combination LED lighting system and angle power strip of this invention which will be referred to hereinafter as "invention" for purposes of conciseness. Invention 10 includes an elongated and horizontally disposed housing 12 which will normally be positioned directly beneath a horizontally extending bottom wall of a kitchen cabinet 13 or the like which is secured to a vertically disposed wall 14 in conventional fashion. The invention 10 may be positioned in different locations if so desired.

Housing 12 has opposite ends 16 and 17. Housing 12 includes a horizontally disposed upper wall member 18 having an inner end 20 and an outer end 22. An inclined wall member 24 extends downwardly and outwardly from the outer end 22 of upper wall member 18. The inner side of wall member 24 has an elongated and horizontally extending slot 26 formed therein which extends between the ends of the housing 12. An intermediate wall member 28 extends downwardly and from the underside of wall member 18 inwardly of outer end 22 thereof. The upper inner end of wall member 28 has an elongated recess 29 formed therein the ends of which serve as screw openings. Wall member 28 has at least one opening 30 formed therein. Wall member 28 includes an inclined wall portion 32 which extends downwardly and inwardly from the lower end thereof. Wall member 28 has an elongated and horizontally extending slot 34 formed in the outer side thereof between the ends of the housing 12. The lower end of wall portion 32 has an elongated and horizontally extending arcuate connector shoulder 36 which extends between the ends of the housing 12. Connector shoulder 36 has an elongated recess 38 formed therein. The ends of recess 38 serve as screw openings.

Housing 12 also includes an inner wall member 40 having an upper end 42 and a lower end 44. The juncture of the upper end 42 of wall member 40 and the inner end 20 of upper wall member 18 has an elongated slot 46 formed therein, the ends of which serve as screw openings. Bottom wall member 48 extends horizontally inwardly from the lower end 44 of inner wall member 40 and has a ball-shaped connector element 50 at its inner end which extends between the ends of bottom wall member 48.

Figure 6:
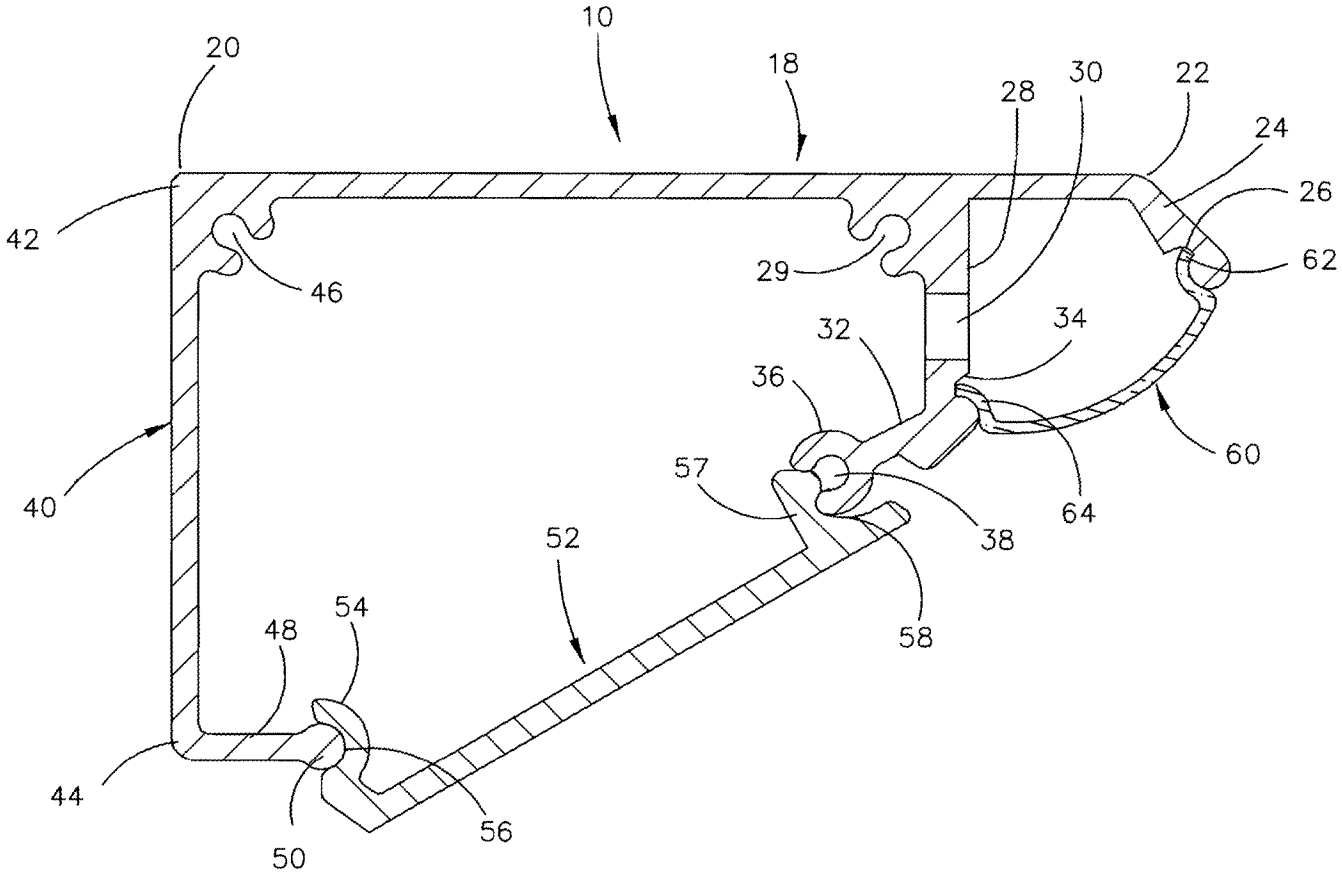
FIG. 6 is a sectional view of the housing of the combination LED lighting system and angle power strip of this invention.
Figure 7:
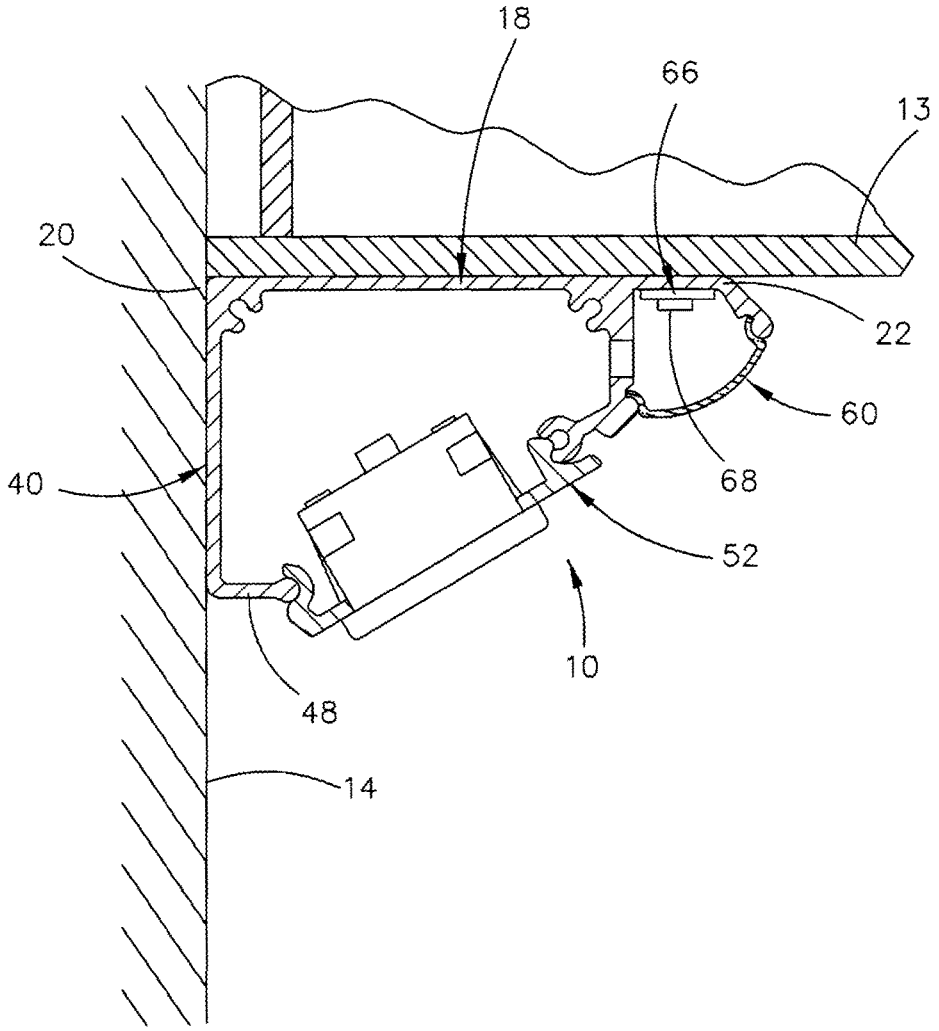
FIG. 7 is a sectional view of the combination LED lighting system and angle power strip of this invention mounted below a cabinet.

The numeral 52 refers to the outer wall member of this invention which serves as a cover for the housing 12 and which is snap-fitted into place to close the lower outer end of the housing 18. The lower inner end of wall member 52 has an elongated protruding connector element 54 extending therefrom which has a recess 56 formed therein which is adapted to receive the connector element 50 therein. The upper inner end of outer wall member 52 has an elongated protruding connector element 57 extending therefrom which has a recess 58 formed therein which is adapted to receive the connector shoulder 36 as seen in FIG. 6.

The numeral 60 refers to an elongated and horizontally extending lens having an upper end 62 and a lower end 64. The upper end 62 of lens 60 is configured to be selectively removably received by slot 34 in wall member 28. The lower end 64 of lens 60 is configured to be selectively removably received by the slot 26 in wall member 28.

The numeral 66 refers to an elongated and horizontally disposed LED lighting system which is preferably an LED light bar having a plurality of spaced-apart LED's 68 mounted thereon. System 66 is secured to the underside of upper wall 18 at end 22 thereof. System 66 could be secured to the outer side of wall member 28. System 66 is designed to direct light downwardly and outwardly through lens 60. A plurality of 120V electrical outlets 70 are mounted in outer wall 52 so as to be an acute angle with respect to upper wall 18 and inner wall 40.

Figure 8:
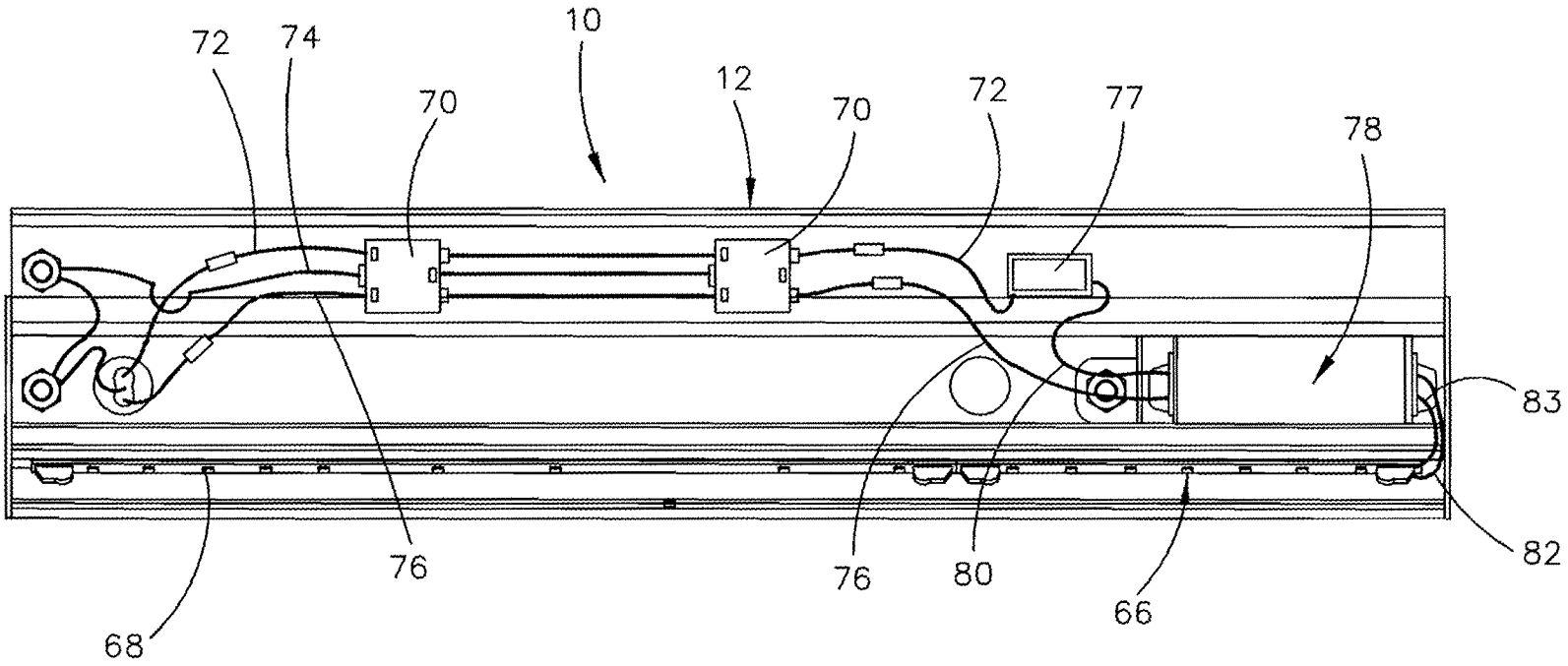
FIG. 8 is an interior view of the combination LED lighting system and angle power strip of this invention.

There are several ways to power the electrical outlets 70 and the LED lights. One way is shown in FIG. 8. Electrical 120 Volt leads 72, 74 and 76 pass through a knock-out in wall 40 and are electrically connected to the outlets 70. The 120 Volt lead 72 is connected to a switch 77 which is connected to a 15 Volt driver 78 by lead 80. Lead 76 is also connected to driver 79 which converts 120 V to 15 V. Leads 82 and 83 connect driver 78 to the LED lighting system 66. The switch 77 may be located on the housing 12 or wherever convenient.

Figure 9:
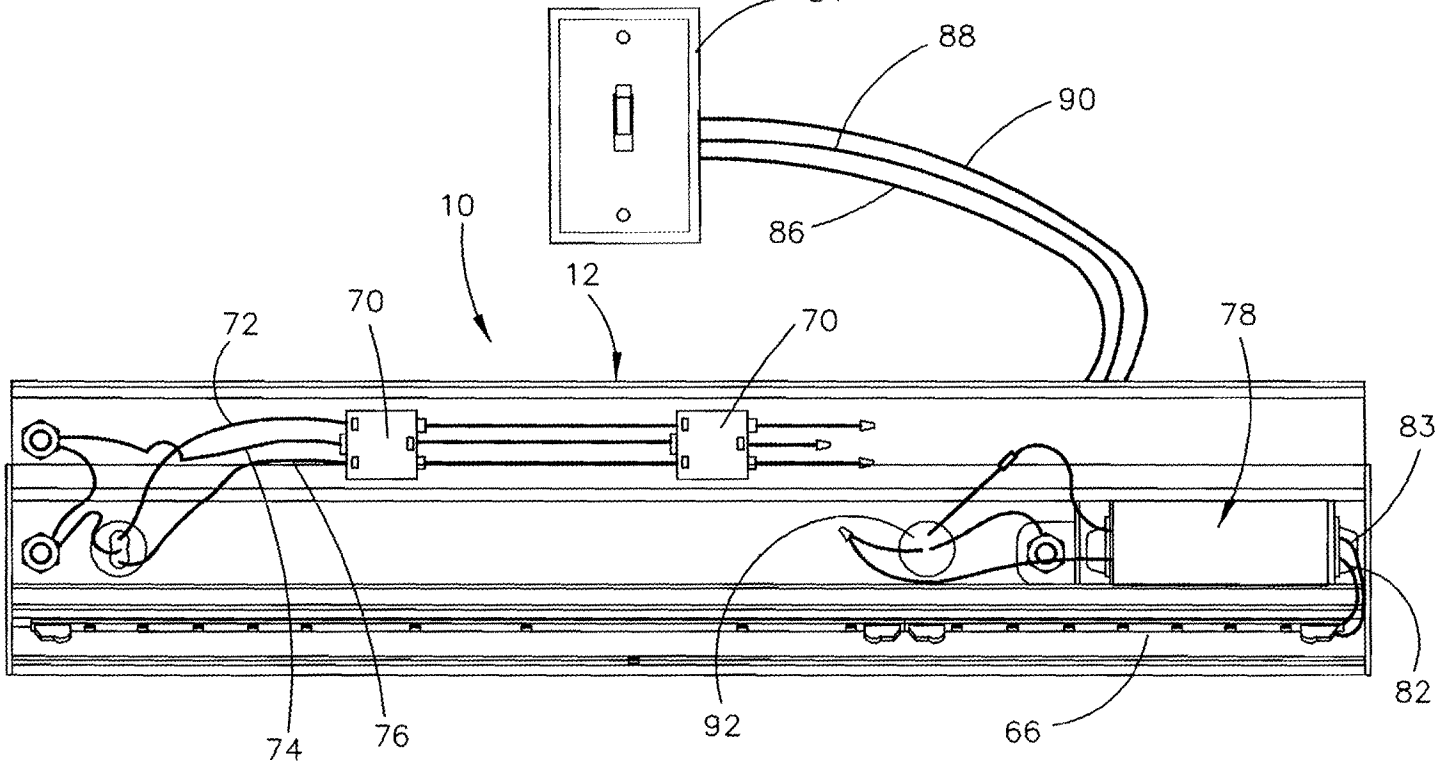
FIG. 9 is another interior view of the combination LED lighting system and angle power strip of this invention.
Figure 10:
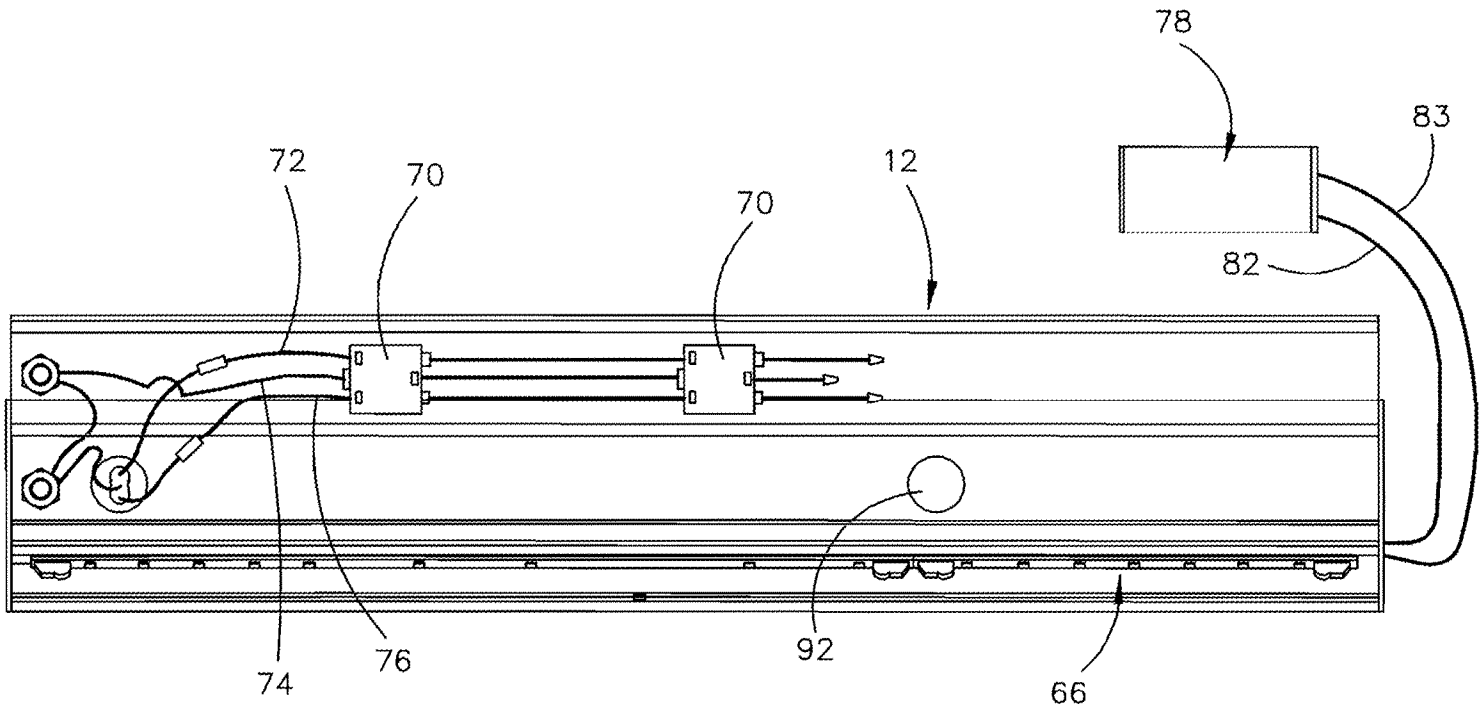
FIG. 10 is a further interior view of the combination LED lighting system and angle power strip of this invention.

FIG. 9 illustrates another way of powering the driver 78 and the LED system 66. In FIG. 9, a remote switch 84 is electrically connected to driver 78 by 120 Volt leads 86, 88 and 90 which enter the housing 12 through a knock-out 92. Yet another way of powering the LED lighting system 66 is shown in FIG. 10. In FIG. 10, the system 66 is powered by a remote driver 78 which is connected to 120V power and a switch.

End 16 of housing 12 is closed by a cap 94 which has screws 98 extending therethrough into the ends of recesses 29 and 38 and slot 46.

End 17 of housing 12 is closed by a cap 96 which has screws 100 extending therethrough into the ends of recesses 29 and 38 and slot 46.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A combination LED lighting system and angle power strip in a single elongated, horizontally disposed housing including:

(a) a horizontally disposed upper wall member having an inner end, an outer end, an upper side and a lower side;

(b) an inclined wall member, having upper and lower ends, extending downwardly and outwardly from said outer end of said horizontally disposed upper wall member;

(c) an intermediate wall member, having upper and lower ends and inner and outer sides, extending downwardly form said horizontally disposed upper wall member between said inner and outer ends of said horizontally disposed upper wall member;

(d) an inclined wall portion, having upper and lower ends, extending downwardly and inwardly from said lower end of said intermediate wall member;

(e) a vertically disposed inner wall member, having upper and lower ends, extending downwardly from said inner end of said horizontally disposed upper wall member;

(f) a horizontally disposed bottom wall member, having inner and outer ends, extending inwardly from said lower end of said inner wall member;

(g) an angularly disposed outer wall member, having upper and lower ends;

(h) said upper end of said angularly disposed outer wall member being removably secured to said lower end of said inclined wall portion;

(i) said lower end of said angularly disposed outer wall member being removably secured to said inner end of said bottom wall member;

(j) an elongated lens having a first end, a second end, an upper end edge and a lower end edge;

(k) said upper end edge of said lens being removably secured to said inclined wall portion;

(l) said lower end edge of said lens being removably secured to said intermediate wall member;

(m) an elongated LED light assembly positioned on said lower side of said horizontally disposed upper wall member inwardly at said outer end thereof or positioned at said outer side of said intermediate wall member configured to direct light downwardly and outwardly through said lens;

(n) a plurality of horizontally spaced-apart electrical outlets positioned in said angularly disposed outer wall member so that said outlets are disposed at an acute angle with respect to said inner wall member and said horizontally disposed upper wall member.

2. The combination LED lighting system and angle power strip of claim 1 wherein the light from said combination LED lighting system and angle power strip is also directed outwardly from said housing.

3. The combination LED lighting system and angle power strip of claim 1 wherein said elongated lens is translucent.

4. The combination LED lighting system and angle power strip of claim 1 wherein said elongated lens has a curved cross-section.

5. The combination LED lighting system and angle power strip of claim 1 wherein said combination LED lighting system and angle power strip includes an LED dimmer.

6. The combination LED lighting system and angle power strip of claim 1 wherein said combination LED lighting system and angle power strip includes an elongated and horizontally disposed LED light bar.

* * * * *